US009192246B2

(12) United States Patent
Chen et al.

(10) Patent No.: US 9,192,246 B2
(45) Date of Patent: Nov. 24, 2015

(54) ROTATABLE TRAY WITH AN ANGLE ADJUSTING FUNCTION

(71) Applicants: Ruibin Chen, Guangdong (CN); Xiao-Jian Zhang, Guangdong (CN)

(72) Inventors: Ruibin Chen, Guangdong (CN); Xiao-Jian Zhang, Guangdong (CN)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 0 days.

(21) Appl. No.: 14/273,562

(22) Filed: May 9, 2014

(65) Prior Publication Data

US 2014/0339861 A1 Nov. 20, 2014

(30) Foreign Application Priority Data

May 14, 2013 (CN) ..... 2013 1 0177356

(51) Int. Cl.

| | |
|---|---|
| ***A47D 15/00*** | (2006.01) |
| ***A47B 83/02*** | (2006.01) |
| ***A47D 1/00*** | (2006.01) |
| ***A47C 7/70*** | (2006.01) |

(52) U.S. Cl.
CPC .. *A47D 1/008* (2013.01); *A47C 7/70* (2013.01)

(58) Field of Classification Search
CPC ..... A47D 1/008; A47C 7/70; A47C 7/68
USPC ..... 297/173, 170, 188.01, 188.21, 188.2, 297/250.1
See application file for complete search history.

(56) References Cited

U.S. PATENT DOCUMENTS

| | | | | |
|---|---|---|---|---|
| 1,382,783 | A | 6/1921 | Howard | |
| 5,865,124 | A | 2/1999 | Wroe | |
| 6,412,862 | B1 * | 7/2002 | Dickerson et al. | 297/188.14 |
| 6,484,989 | B1 * | 11/2002 | Connery | 248/311.2 |
| 6,592,180 | B2 * | 7/2003 | Combs | 297/188.14 |
| 8,979,190 | B2 * | 3/2015 | Madrigal et al. | 297/162 |
| 2008/0302938 | A1 * | 12/2008 | Goodwin et al. | 248/288.51 |
| 2009/0039620 | A1 | 2/2009 | Ryan | |
| 2012/0217773 | A1 * | 8/2012 | Jue | 297/188.14 |
| 2013/0180940 | A1 * | 7/2013 | Tsai | 211/119.007 |
| 2014/0225402 | A1 * | 8/2014 | Dehli | 297/173 |

FOREIGN PATENT DOCUMENTS

| | | | |
|---|---|---|---|
| CN | 202358155 | U | 8/2012 |
| DE | 20 2011 051 988 | U1 | 1/2012 |
| GB | 1188899 | A | 4/1970 |
| JP | 2000210163 | | 8/2000 |
| JP | 201255678 | | 3/2012 |

* cited by examiner

*Primary Examiner* — Milton Nelson, Jr.
(74) *Attorney, Agent, or Firm* — Winston Hsu; Scott Margo

(57) ABSTRACT

A rotatable tray is installed on a child seat for accommodating a container, and the rotatable tray includes a platform, a fixing base, a positioning base, a resilient component and a supporting base. The platform includes a communicating chamber, and the fixing base is fixed in the communicating chamber. The positioning base includes a first engaging portion, and the positioning base is slidably disposed in the communicating chamber. The resilient component is disposed between the fixing base and the positioning base. The supporting base is connected to the platform, an engaging base protrudes from an end of the supporting base, and a second engaging portion is disposed on the supporting base. The engaging base is pivoted in the communicating chamber so that the platform can rotate relative to the supporting base. The resilient component drives the first engaging portion to selectively engage with the second engaging portion.

16 Claims, 14 Drawing Sheets

ROTATABLE TRAY WITH AN ANGLE ADJUSTING FUNCTION

BACKGROUND OF THE INVENTION

1. Field of the Invention

The present invention is to provide a rotatable tray with an angle adjusting function, and more specifically, to a rotatable tray disposed on a child seat and capable of adjusting an angle of the rotatable tray relative to the child seat.

2. Description of the Prior Art

With the growth of requirements of child products, child seats have become increasingly diverse, and accessories to the child seats have more complete functions. For conveniently feeding a child sitting in the child seat, a tray is performed to equip with the child seat. Food can be placed on the tray as the child sits in the child seat equipped with tray, so that parents can conveniently feed the child.

However, a conventional tray is usually fixed on the child seat for stability, so that a child cannot easily sit in and get out of the child seat and might get hurt as hitting the tray. It is more convenient for a child to sit in the child seat with a detachable tray. However, the detachment and installation of the conventional detachable tray are complicated. Furthermore, after installing the detachable tray on the child seat, the detachable tray is fixed relative to the child seat and is not flexible for different requirements. Therefore, it is an important issue to develop a tray capable of adjusting an angle of the tray relative to the child seat in the mechanical design of the child product.

SUMMARY OF THE INVENTION

The present invention is to provide a rotatable tray with an angle adjusting function, and more specifically, to a rotatable tray disposed on a child seat and capable of adjusting an angle of the rotatable tray relative to the child seat to solve the above drawbacks.

According to the disclosure, a rotatable tray is installed on a child seat for accommodating a container. The rotatable tray includes a platform, a fixing base, a positioning base, a resilient component and a supporting base. The platform includes a communicating chamber. The fixing base is fixed in the communicating chamber of the platform. The positioning base includes a first engaging portion, and the positioning base is slidably disposed in the communicating chamber of the platform. The resilient component is disposed between the fixing base and the positioning base. The supporting base is connected to the platform. An engaging base protrudes from an end of the supporting base, and a second engaging portion is disposed on the supporting base. The engaging base is pivoted in the communicating chamber so that the platform rotates relative to the supporting base, and the resilient component drives the first engaging portion to selectively engage with the second engaging portion.

According to the disclosure, the positioning base is circumferentially fixed and slidably up and down disposed in the communicating chamber, the first engaging portion is disposed on an end of the positioning base facing the second engaging portion, and the first engaging portion protrudes from the end of the positioning base.

According to the disclosure, the first engaging portion includes a plurality of first engaging teeth, the second engaging portion correspondingly includes a plurality of second engaging teeth surrounding a central axis of the engaging base, and the resilient component is for driving the plurality of first engaging teeth to engage with the plurality of second engaging teeth.

According to the disclosure, the first engaging portion includes twelve first engaging teeth, the second engaging portion includes twelve second engaging teeth, and an angle between the two adjacent first engaging teeth or the two adjacent second engaging teeth is 30 degree substantially.

According to the disclosure, a stopping protrusion is formed on an outer sidewall of the engaging base, a sliding slot is formed on an inner sidewall of the positioning base, the sliding slot is a curve-shaped concave structure, the stopping protrusion is slidably installed in the sliding slot, and the stopping protrusion slides in the sliding slot as the positioning base rotates.

According to the disclosure, the sliding slot is a curve-shaped slot, and an angle of the curve-shaped slot is 180 degree substantially.

According to the disclosure, the fixing base includes a hollow chamber, an opening is formed on an end of the hollow chamber, and two resilient arms protrude from inner sides of the fixing base.

According to the disclosure, an annular slot is formed on an end of the engaging base, the engaging base is pivoted on the fixing base, and the two resilient arms are engaged inside the annular slot.

According to the disclosure, the platform further includes a pivoting portion and at least one containing space, and the communicating chamber is connected to the pivoting portion.

According to the disclosure, a concave portion is formed on a sidewall of the containing space, a shape of the container is corresponding to a shape of the containing space, and a protruding portion is formed on an outer sidewall of the container for engaging with the concave portion so as to fix the container in the containing space.

According to the disclosure, the child seat includes a T-shaped connecting portion, a connecting slot is correspondingly disposed on the supporting base, and the T-shaped connecting portion is inserted into the connecting slot.

According to the disclosure, an engaging hole is disposed on the T-shaped connecting portion, the rotatable tray further includes an engaging component and a first spring, a central portion of the engaging component is pivoted on the supporting base, an engaging hook is formed on an end of the engaging component, a quick release pressing portion is formed on the other end of the engaging component, and the first spring is disposed between an inner sidewall of the supporting base and the quick release pressing portion so as to drive the engaging hook to engage with the engaging hole.

According to the disclosure, the supporting base further includes a first connecting component and a second connecting component, a pivoting shaft is formed on an end of the second connecting component, and the first connecting component is pivoted on the second connecting component through the pivoting shaft.

According to the disclosure, the first connecting component is pivoted on the second connecting component in a front and rear direction of the child seat.

According to the disclosure, the rotatable tray further includes a positioning mechanism disposed between the first connecting component and the second connecting component, and the positioning mechanism is for fixing the first connecting component on the second connecting component.

According to the disclosure, the positioning mechanism includes a gear, a second spring and a third engaging portion. The gear slidably sheathes on the pivoting shaft. The second spring is disposed between the gear and the first connecting component. The third engaging portion is disposed on the second connecting component and surrounds the pivoting shaft, the third engaging portion includes a plurality of third engaging teeth, and the second spring drives the gear to selectively engage with the third engaging portion as the first connecting component rotates.

The rotatable tray of the present invention includes the communicating chamber disposed on a side of the platform. The fixing base is fixed in the communicating chamber, the engaging base protrudes from the end of the supporting base so as to pivot on the fixing base, so that the platform can rotate relative to the supporting base. The positioning base is slidably up and down disposed and circumferentially fixed in the communicating chamber so that the positioning base can rotate with the platform simultaneously. The resilient component is disposed between the fixing base and the positioning base, the first engaging portion is disposed on the positioning base, and the second engaging portion is disposed on the supporting base correspondingly. As the platform rotates, the positioning base compresses the resilient component to slide upward in the communicating chamber so as to separate the first engaging portion from the second engaging portion, so that the angle of the platform relative to the child seat can be adjusted. After finishing adjusting the angle of the platform, the resilient component drives the positioning base slides downward to engage the first engaging portion with the second engaging portion, so that the positioning portion can be fixed on the supporting base. Hence, the rotatable tray is not necessary to be detached from the child seat, and the angle of the rotatable tray relative to the child seat can be adjusted so that the child can easily sit in the child seat. The operation of the child seat is easy and rapidly.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
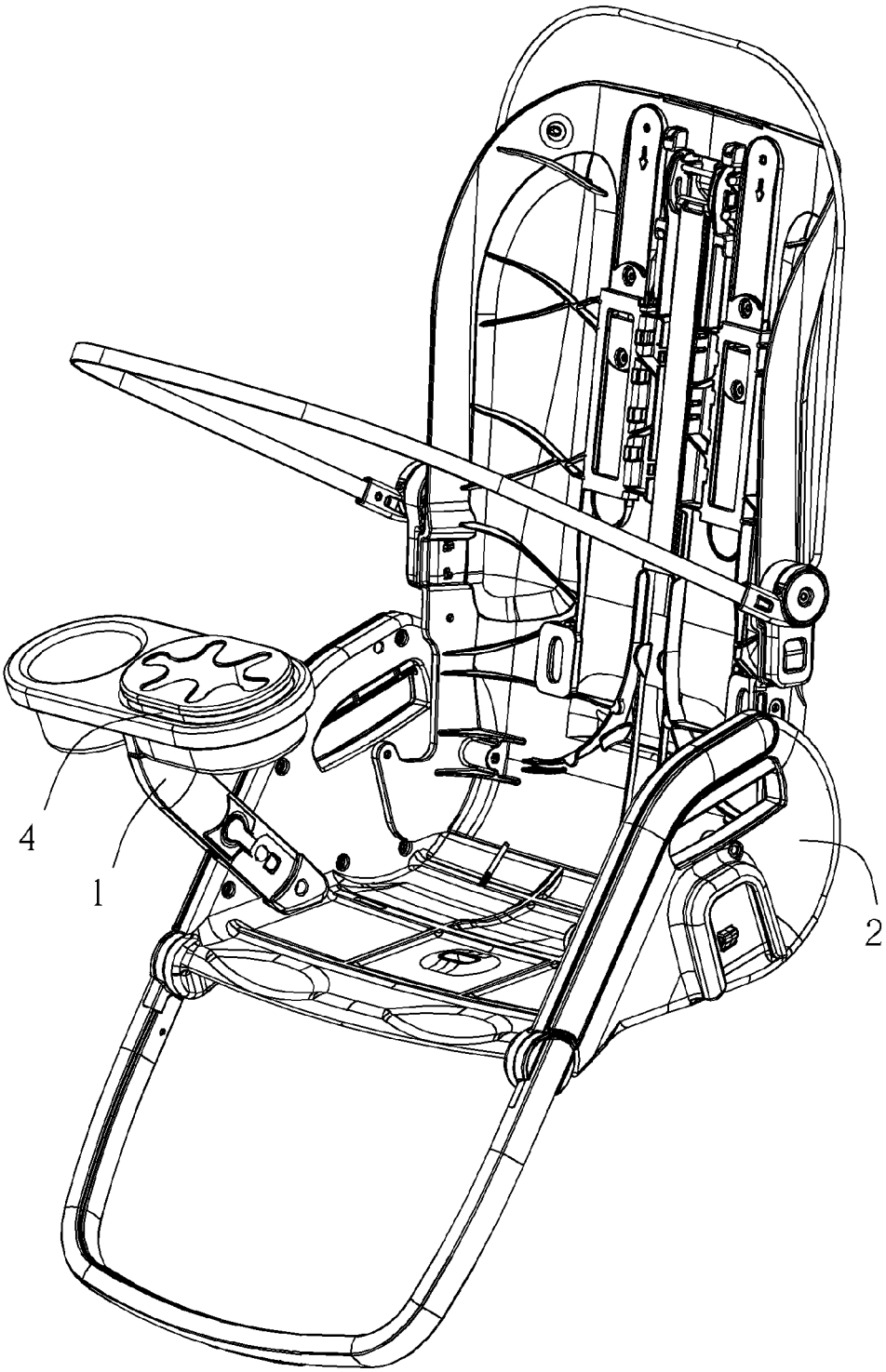
FIG. 1 is a diagram of a child seat according to an embodiment of the present invention.
Figure 2:
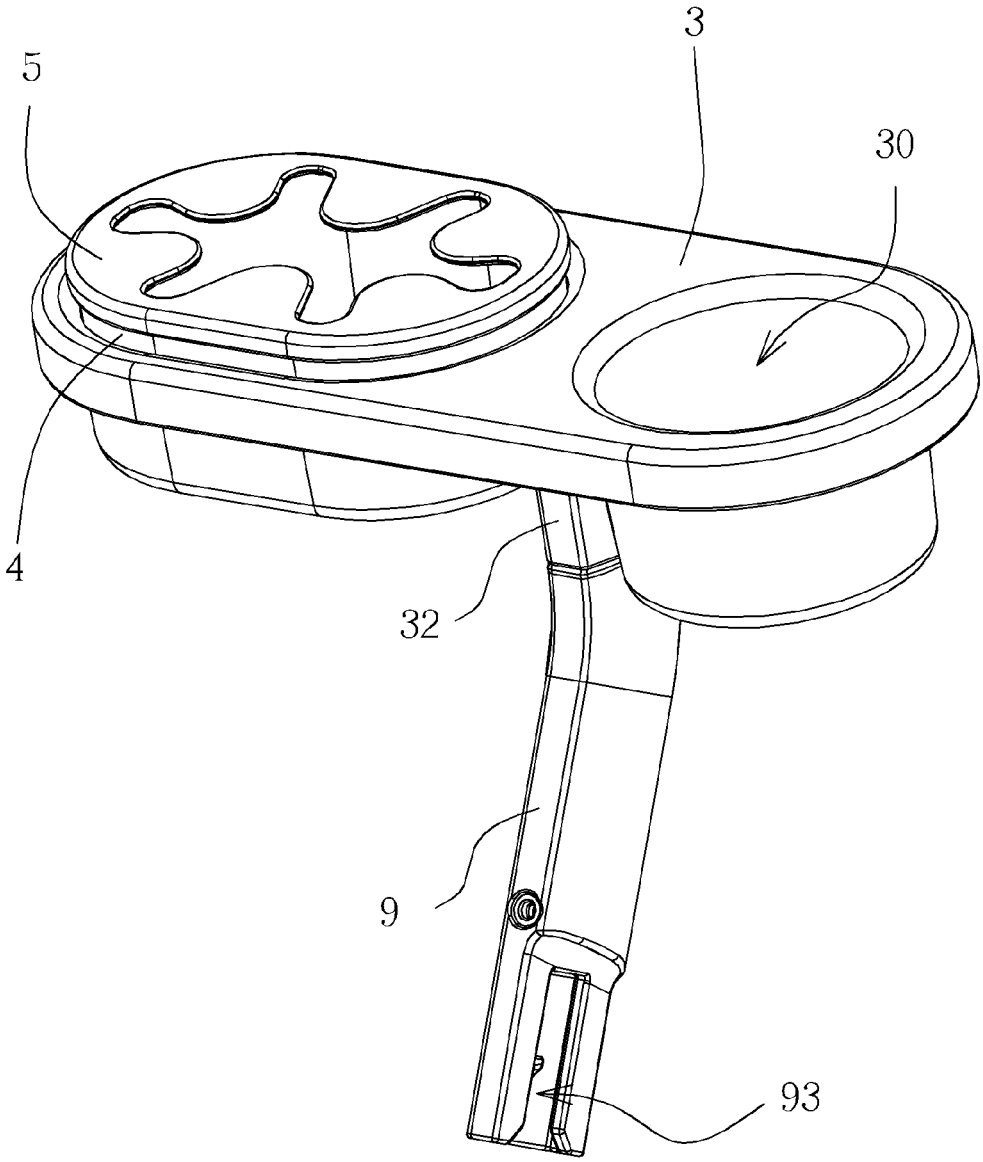
FIG. 2 is a diagram of a rotatable tray according to the embodiment of the present invention.
Figure 3:
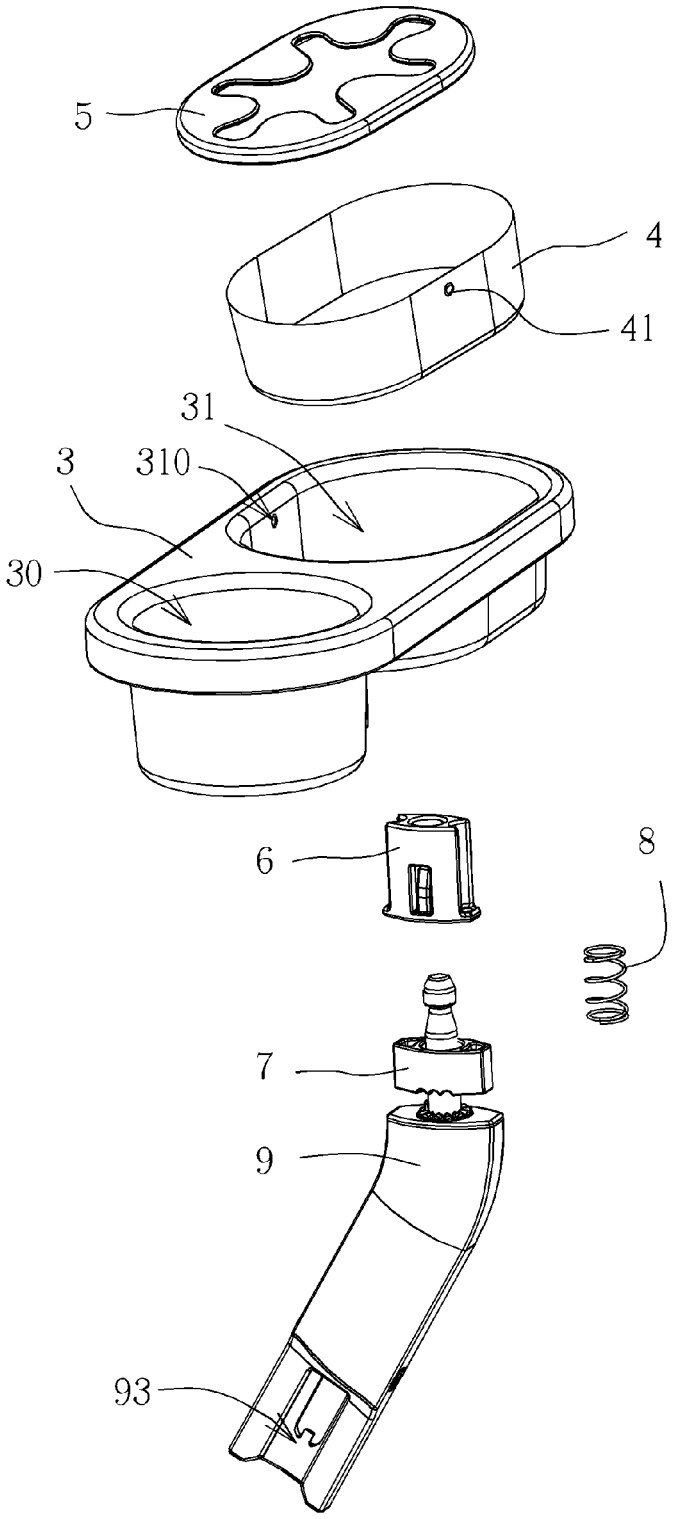
FIG. 3 is an exploded diagram of the rotatable tray according to the embodiment of the present invention.

Please refer to FIG. 1, FIG. 2 and FIG. 3. FIG. 1 is a diagram of a child seat 2 according to an embodiment of the present invention. FIG. 2 is a diagram of a rotatable tray 1 according to the embodiment of the present invention. FIG. 3 is an exploded diagram of the rotatable tray 1 according to the embodiment of the present invention. The rotatable tray 1 is installed on the child seat 2 for accommodating a container 4. The rotatable tray 1 includes a platform 3, a fixing base 6, a positioning base 7, a resilient component 8 and a supporting base 9. The platform 3 includes a pivoting portion 32 and at least one containing space. As shown in FIG. 3, a first containing space 30 and a second containing space 31 are respectively formed on two ends of the platform 3. The first containing space 30 and the second containing space 31 can accommodate cups or food so that parents can conveniently feed a child. In addition, an engaging structure can be formed on each of the first containing space 30 and the second containing space 31, and another engaging structure is correspondingly formed on the container 4. The container 4 can be fixed in the first containing space 30 or the second containing space through the engagement of the engaging structures. In this embodiment, the container 4 is accommodated in the second containing space 31, a cover 5 is disposed on the container 4, and a shape of the container 4 is corresponding to a shape of the containing space 31. A concave portion 310 is formed on a sidewall of the second containing space 31, and a protruding portion 41 is formed on an outer sidewall of the container 4 for engaging with the concave portion 310, so as to fix the container 4 in the second containing space 31 more stably.

Figure 4:
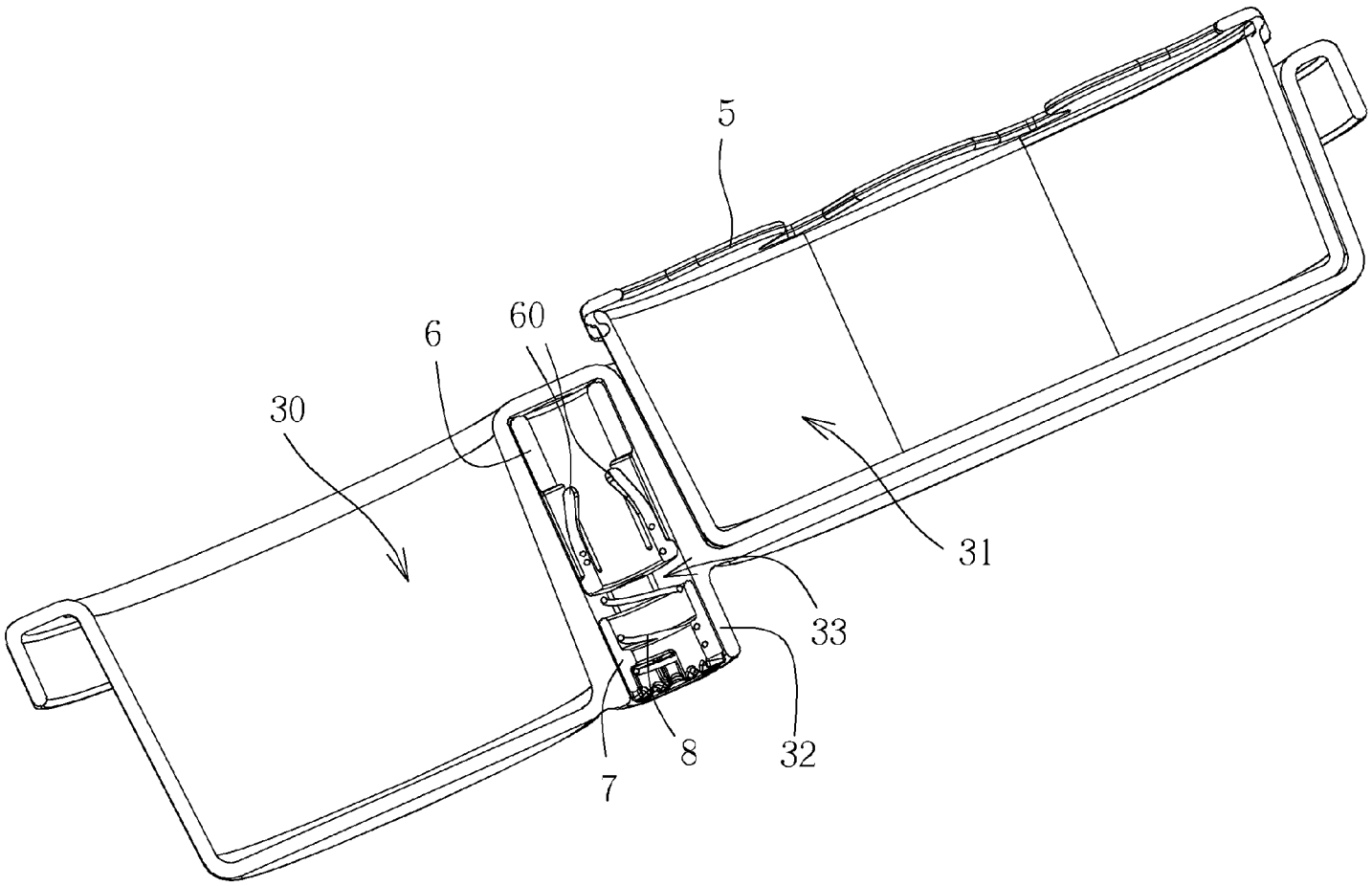
FIG. 4 is a partial cross-sectional diagram of the rotatable tray according to the embodiment of the present invention.

Please refer to FIG. 4. FIG. 4 is a partial cross-sectional diagram of the rotatable tray 1 according to the embodiment of the present invention. The platform 3 protrudes downward to form a pivoting portion 32. The pivoting portion 32, the first containing space 30 and the second containing space 31 can be integrally formed, a communicating chamber 33 is further formed on the platform 3, and the communicating chamber 33 includes an opening portion. In this embodiment, a cross section of the communicating chamber 33 is rectangular, but not limited to this embodiment. For example, the cross section of the communicating chamber 33 can be formed in another shape. The fixing base 6 is fixed on an end of the communicating chamber 33 away from the opening portion and contacts against a top inner sidewall of the communicating chamber 33. The fixing base 6 includes a hollow chamber, an opening is formed on an end of the hollow chamber, and two resilient arms 60 protrude from inner sides of the fixing base 6.

Figure 5:
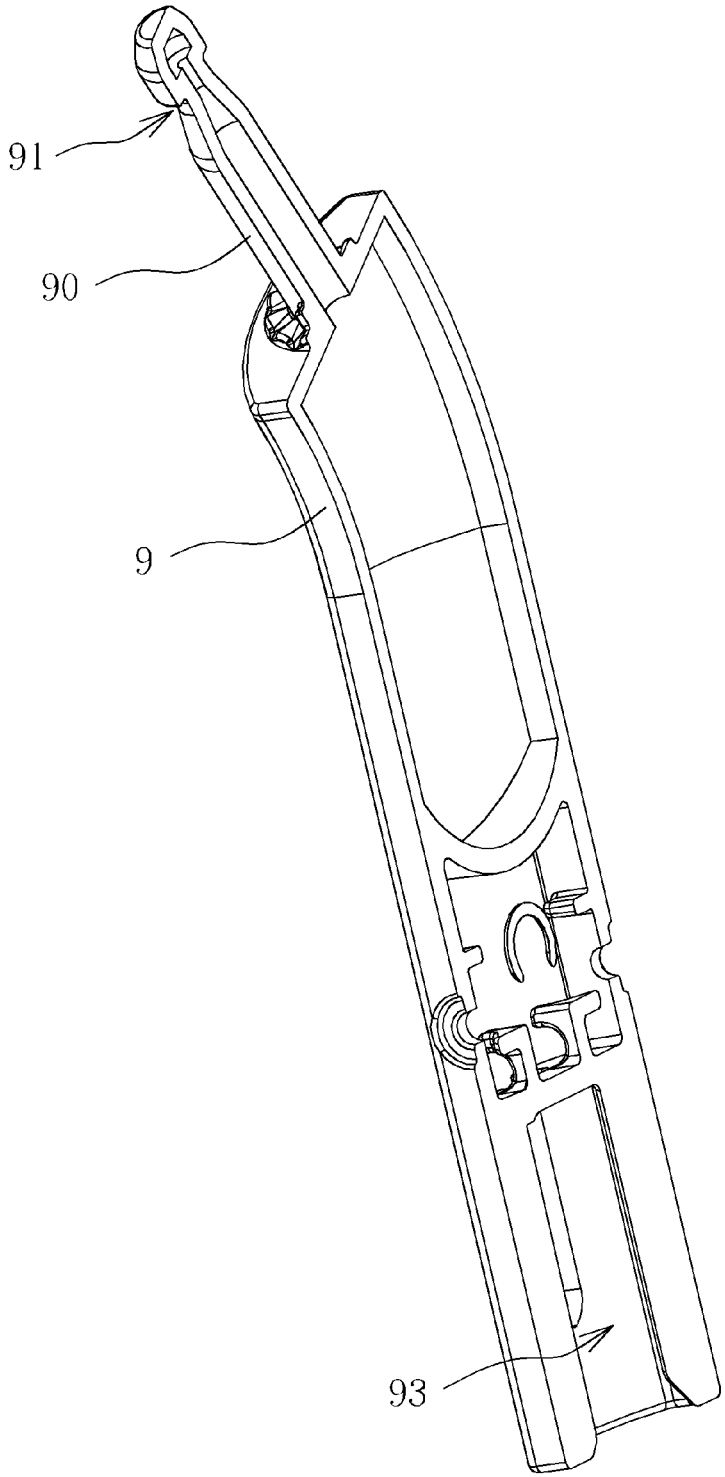
FIG. 5 is a cross-sectional diagram of a supporting base according to the embodiment of the present invention.
Figure 6:
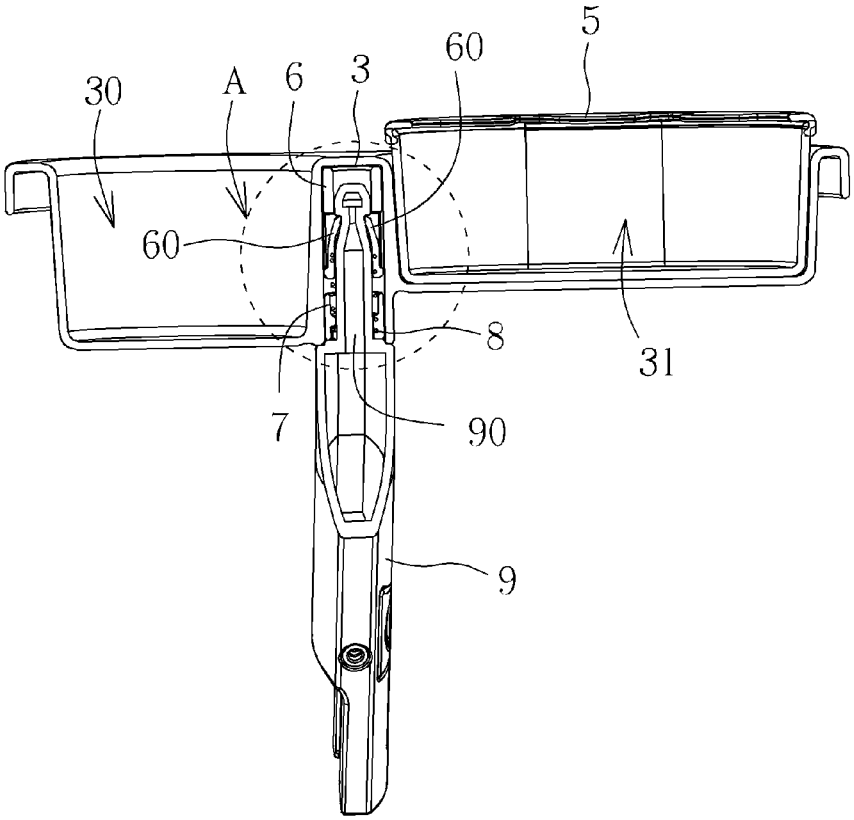
FIG. 6 is a cross-sectional diagram of the rotatable tray according to the embodiment of the present invention.
Figure 7:
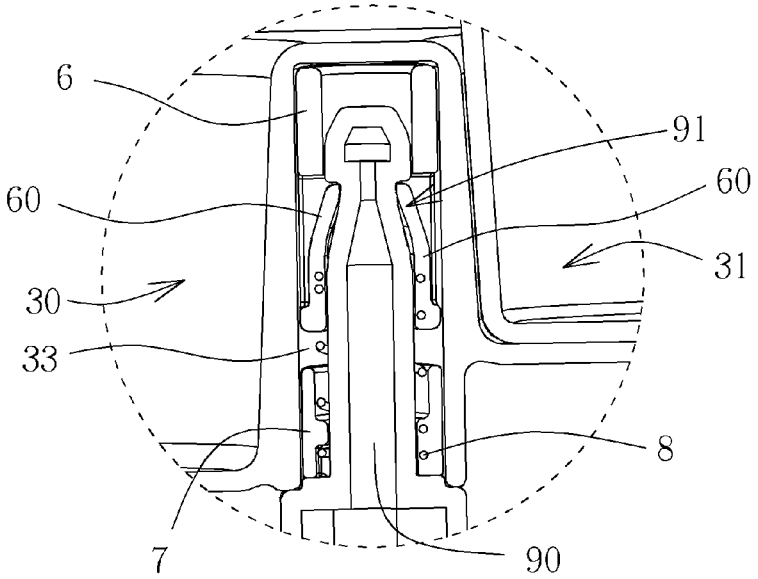
FIG. 7 is an enlarged diagram of area A in FIG. 6 according to the embodiment of the present invention.

Please refer to FIG. 5 to FIG. 7. FIG. 5 is a cross-sectional diagram of the supporting base 9 according to the embodiment of the present invention. FIG. 6 is a cross-sectional diagram of the rotatable tray 1 according to the embodiment of the present invention. FIG. 7 is an enlarged diagram of area A in FIG. 6 according to the embodiment of the present invention. The supporting base 9 is connected to the platform 3. An engaging base 90 protrudes from an end of the supporting base 9, and an annular slot 91 is formed on an end of the engaging base 90. The engaging base 90 is pivoted on the fixing base 6 so that the supporting base 9 can pivot on the platform 3. The two resilient arms 60 are engaged inside the annular slot 91. Therefore, the platform 3 can pivot relative to the supporting base 9, and the platform 3 can engage with the supporting base 9 through the two resilient arms 60, so that the platform 3 does not detach from the supporting base 9 as pivoting relative to the supporting base 9.

Please continue to refer to FIG. 5 to FIG. 7. The positioning base 7 can be slidably up and down disposed in the communicating chamber 33. Specifically, the positioning base 7 is disposed in an end of the communicating chamber 33 close to the opening portion of the communicating chamber 33, and a shape of the positioning base 7 is corresponding to a shape of the communicating chamber 33. In this embodiment, a cross section of the positioning base 7 can be rectangular. The positioning base 7 can be circumferentially fixed and slidably up and down disposed in the communicating chamber 33 of the platform 3, and the positioning base 7 can rotate with the platform 3.

Figure 8:
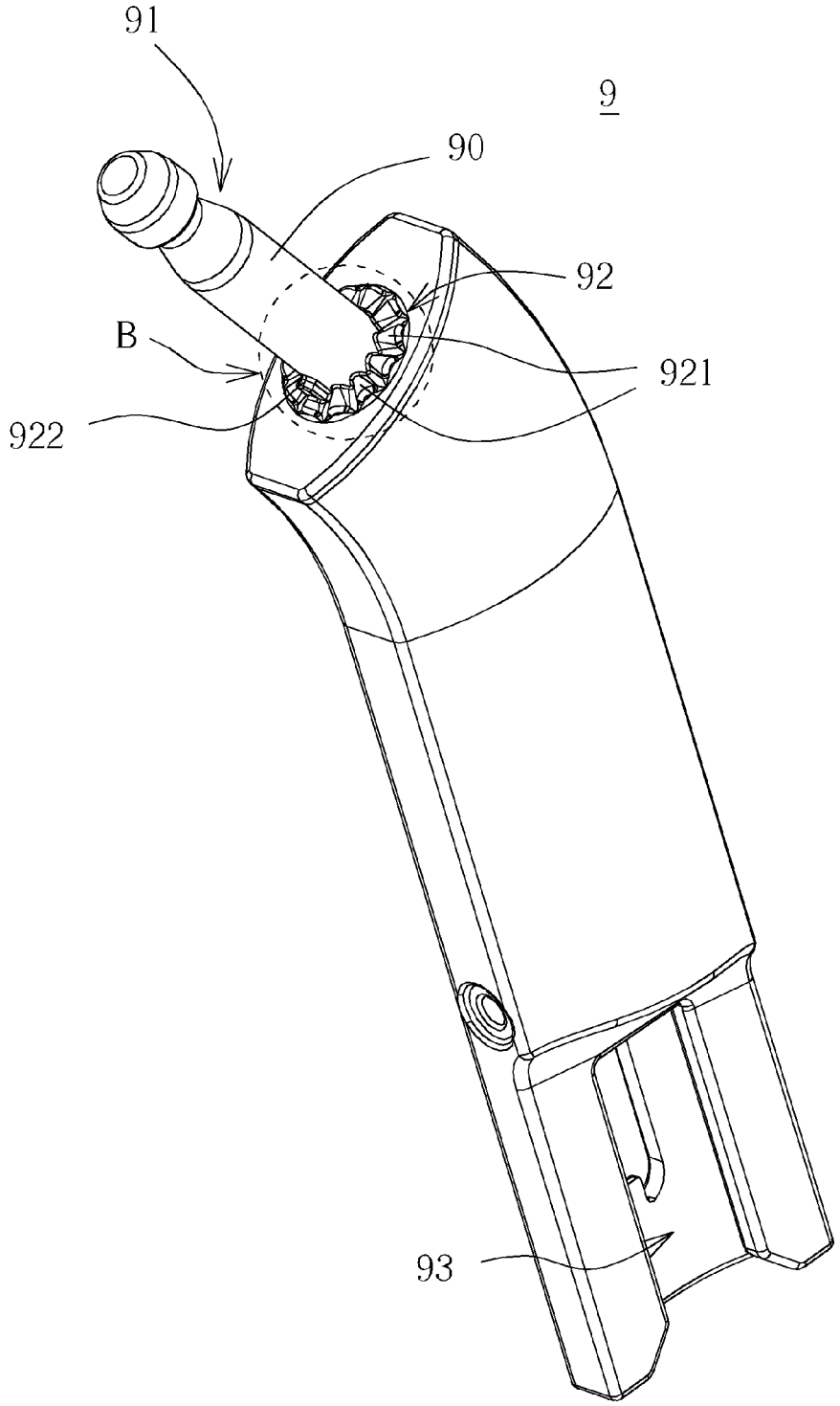
FIG. 8 is a diagram of the supporting base according to the embodiment of the present invention.
Figure 9:
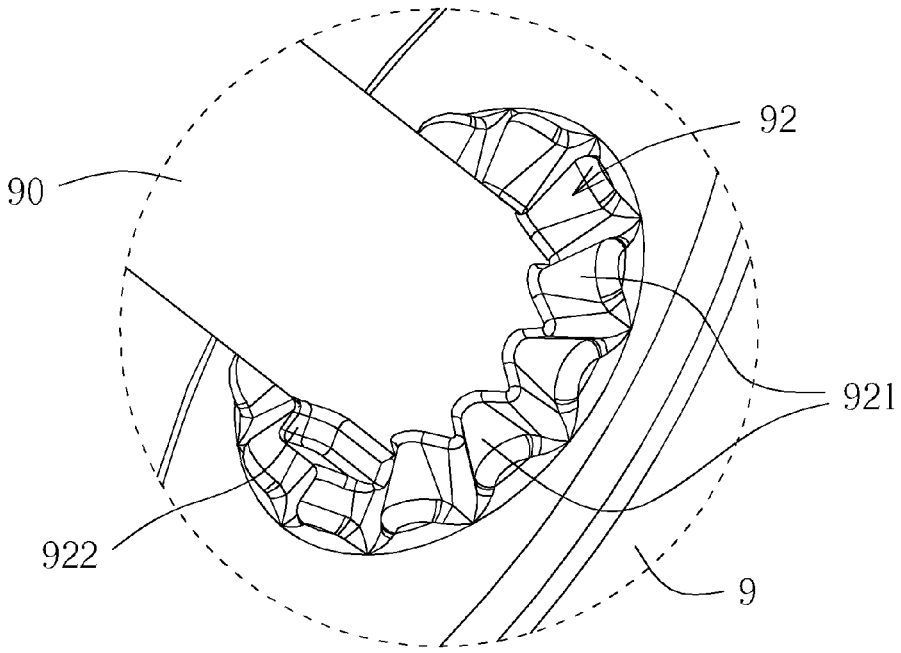
FIG. 9 is an enlarged diagram of area B in FIG. 8 according to the embodiment of the present invention.
Figure 10:
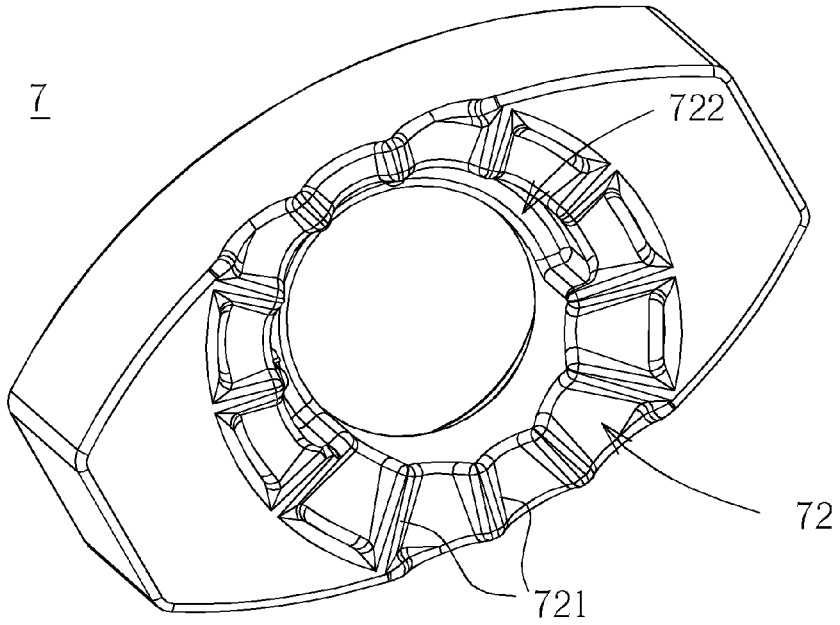
FIG. 10 is a diagram of a positioning base according to the embodiment of the present invention.

Please refer to FIG. 7 to FIG. 10. FIG. 8 is a diagram of the supporting base 9 according to the embodiment of the present invention. FIG. 9 is an enlarged diagram of area B in FIG. 8 according to the embodiment of the present invention. FIG. 10 is a diagram of the positioning base 7 according to the embodiment of the present invention. A first engaging portion 72 is disposed on an end of the positioning base 7 facing to the supporting base 9. The first engaging portion 72 protrudes from the end of the positioning base 7, and the first engaging portion 72 includes a plurality of first engaging teeth 721. In this embodiment, the first engaging portion 72 includes twelve first engaging teeth 721 arranged in equal intervals, and an included angle between any two adjacent first engaging teeth 721 can be substantially 30 degrees. A second engaging portion 92 is disposed on an end of the supporting base 9 facing to the positioning base 7 correspondingly, and the second engaging portion 92 includes a plurality of second engaging teeth 921. In this embodiment, the second engaging portion 92 includes twelve second engaging teeth 921 arranged in equal intervals. The second engaging teeth 921 surround a central axis of the engaging base 90, and an included angle between any two adjacent second engaging teeth 921 can be substantially 30 degrees.

As shown in FIG. 7, the resilient component 8 is disposed between the fixing base 6 and the positioning base 7 for driving the first engaging teeth 721 to engage with the second engaging teeth 921, so as to move the positioning base 7 close to the supporting base 9. Thus, the first engaging teeth 721 are engaged with the second engaging teeth 921, and the first engaging portion 72 can selectively engage with the second engaging portion 92, so that the platform 3 can rotate relative to the supporting base 9 to be fixed on the supporting base 9. A stopping protrusion 922 is formed on an outer sidewall of the engaging base 90, a sliding slot 722 is formed on an inner sidewall of the positioning base 7, and the sliding slot 722 can be a curve-shaped concave structure. In this embodiment, the sliding slot 722 is a curve-shaped slot, and an angle of the curve-shaped slot can be substantially 180 degrees. The stopping protrusion 922 slides in the sliding slot 722 as the positioning base 7 rotates, so as to constrain a rotating angle of the platform 3 relative to the supporting base 9.

Please refer to FIG. 1, FIG. 3 and FIG. 8. The stopping protrusion 922 is disposed on a side of the supporting base 9 close to the child seat 2, and the sliding slot 722 is disposed on the positioning base 7 at a right side or a left side of the child seat 2. The stopping protrusion 922 is engaged with the sliding slot 722 so as to constrain the rotating angle of the platform 3 relative to the supporting base 9. In this embodiment, the second containing space 31 has a longer length than the first containing space 30, so that the second containing space 31 only can rotate in a rotating direction away from the child seat 2. The second containing space 31 does not rotate close to the child seat 2 so as to prevent from hitting the child sitting in the child seat 2 during rotation. The stopping protrusion 922 can be disposed on anywhere of the outer sidewall of the engaging base 90, and the sliding slot 722 is disposed at a corresponding position of the positioning base 7 so as to constrain the rotating direction of the platform 3.

Figure 11:
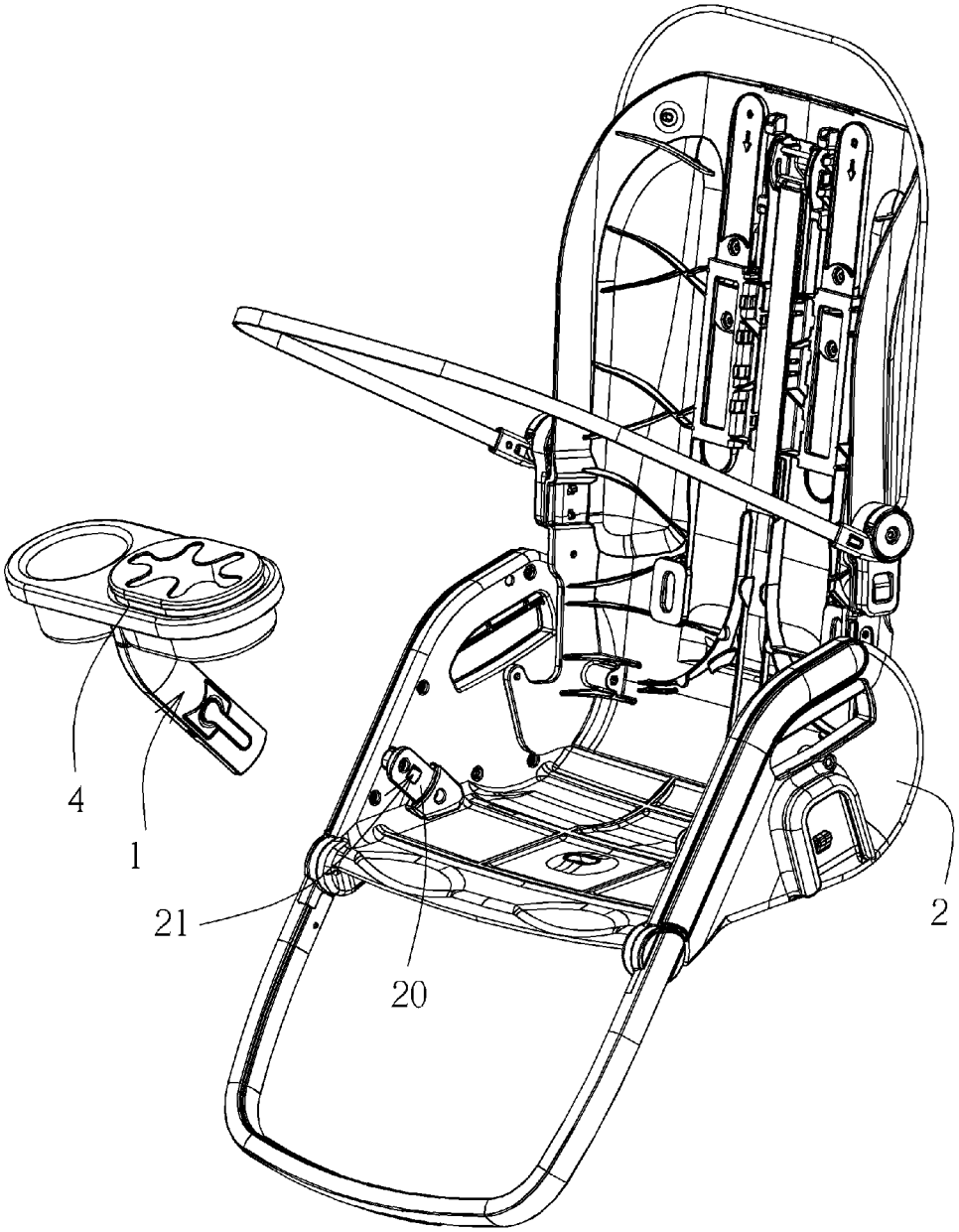
FIG. 11 is a diagram of the rotatable tray separate from the child seat according to the embodiment of the present invention.
Figure 12:
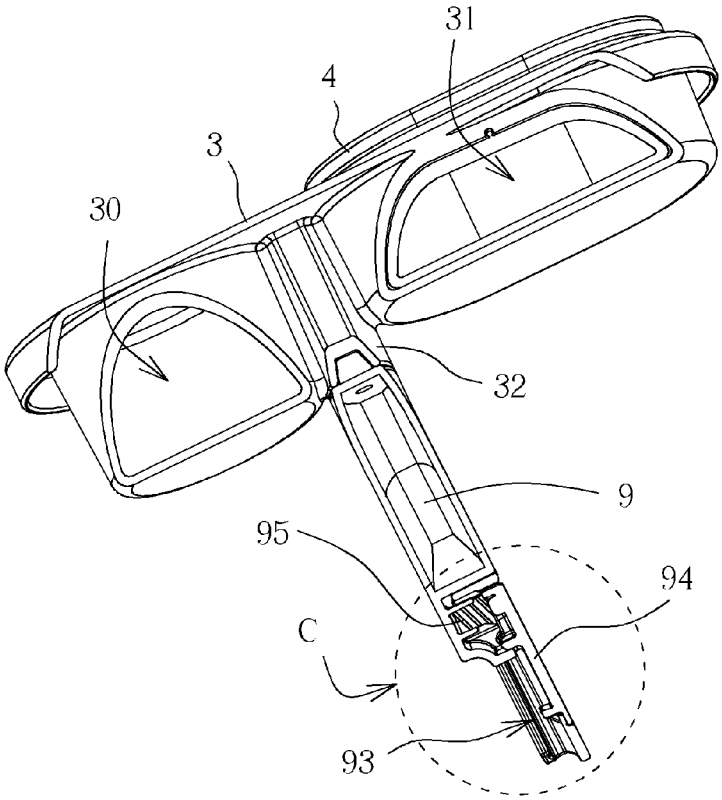
FIG. 12 is another partial cross-section diagram of the rotatable tray according to the embodiment of the present invention.
Figure 13:
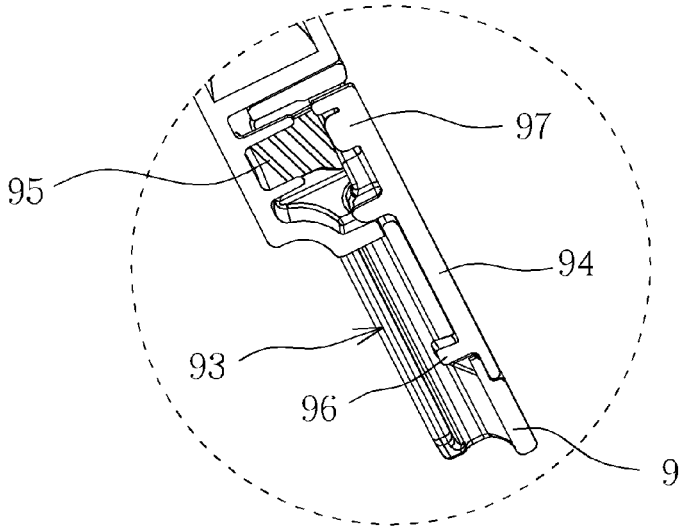
FIG. 13 is an enlarged diagram of area C in FIG. 12 according to the embodiment of the present invention.

Please refer to FIG. 11 to FIG. 13. FIG. 11 is a diagram of the rotatable tray 1 separate from the child seat 2 according to the embodiment of the present invention. FIG. 12 is another partial cross-section diagram of the rotatable tray 1 according to the embodiment of the present invention. FIG. 13 is an enlarged diagram of area C in FIG. 12 according to the embodiment of the present invention. As shown in FIG. 11, the child seat 2 includes a T-shaped connecting portion 20, and an engaging hole 21 is formed on the T-shaped connecting portion 20. A connecting slot 93 is correspondingly disposed on the supporting base 9, and the T-shaped connecting portion 20 is inserted into the connecting slot 93 so as to install the rotatable tray 1 on the child seat 2.

Specifically, the rotatable tray 1 further includes an engaging component 94 and a first spring 95, a central portion of the engaging component 94 is pivoted on the supporting base 9, an engaging hook 96 is formed on an end of the engaging component 94, a quick release pressing portion 97 is formed on the other end of the engaging component 94, and the first spring 95 is disposed between an inner sidewall of the supporting base 9 and the quick release pressing portion 97 so as to drive the engaging hook 96 to engage with the engaging hole 21. As the quick release pressing portion 97 is pressed, the engaging hook 96 is separated from the engaging hole 21 so as to detach the rotatable tray 1 from the child seat 2.

Figure 14:
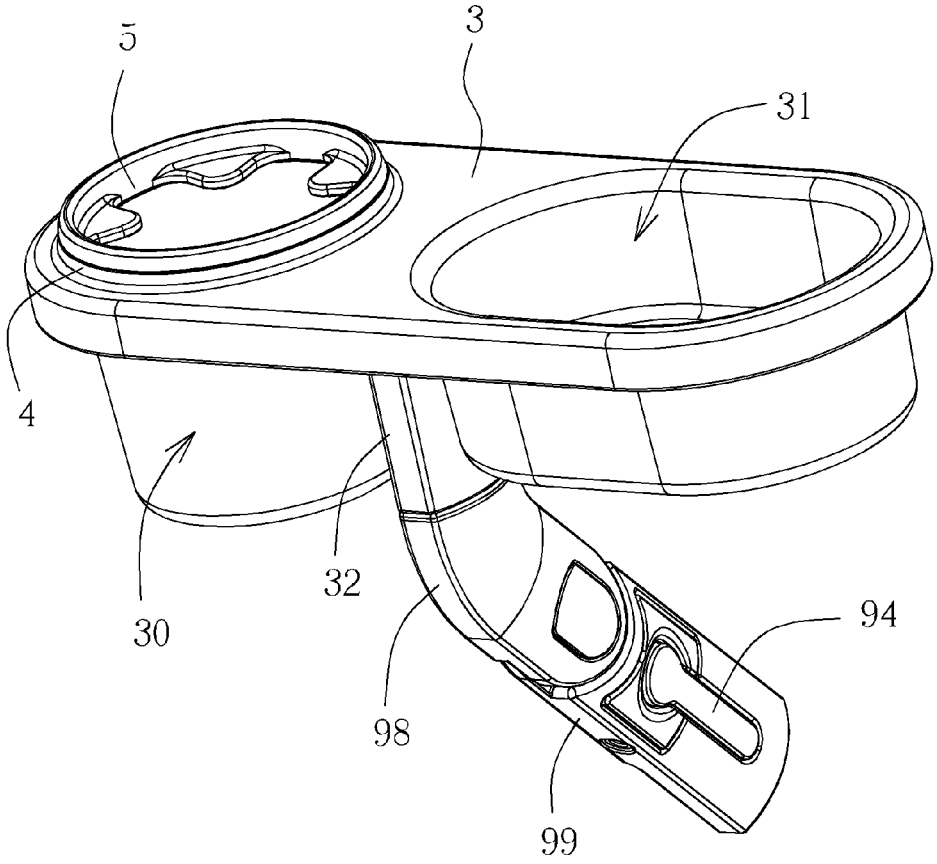
FIG. 14 is a diagram of a rotatable tray according to another embodiment of the present invention.
Figure 15:
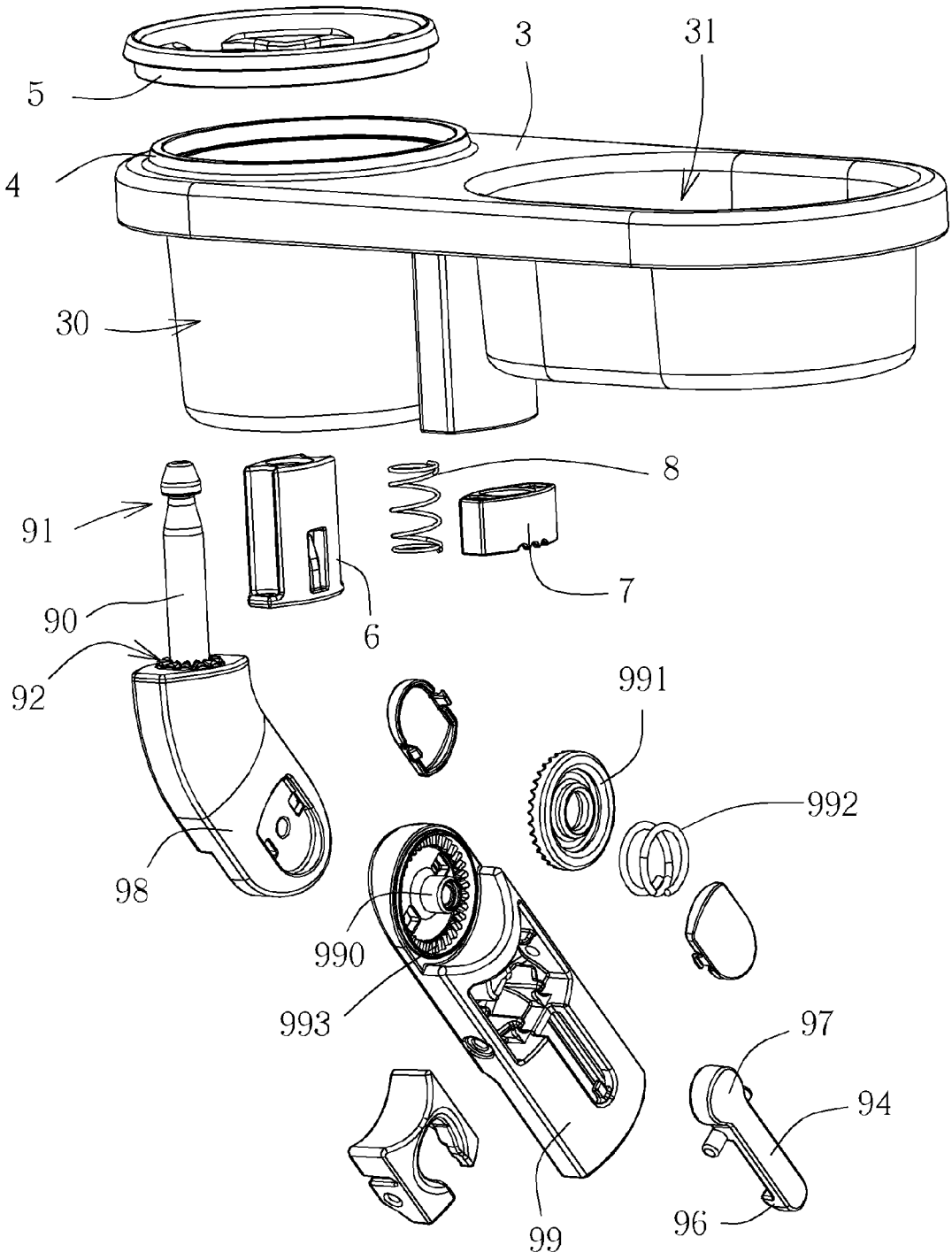
FIG. 15 is an exploded diagram of the rotatable tray according to another embodiment of the present invention.
Figure 16:
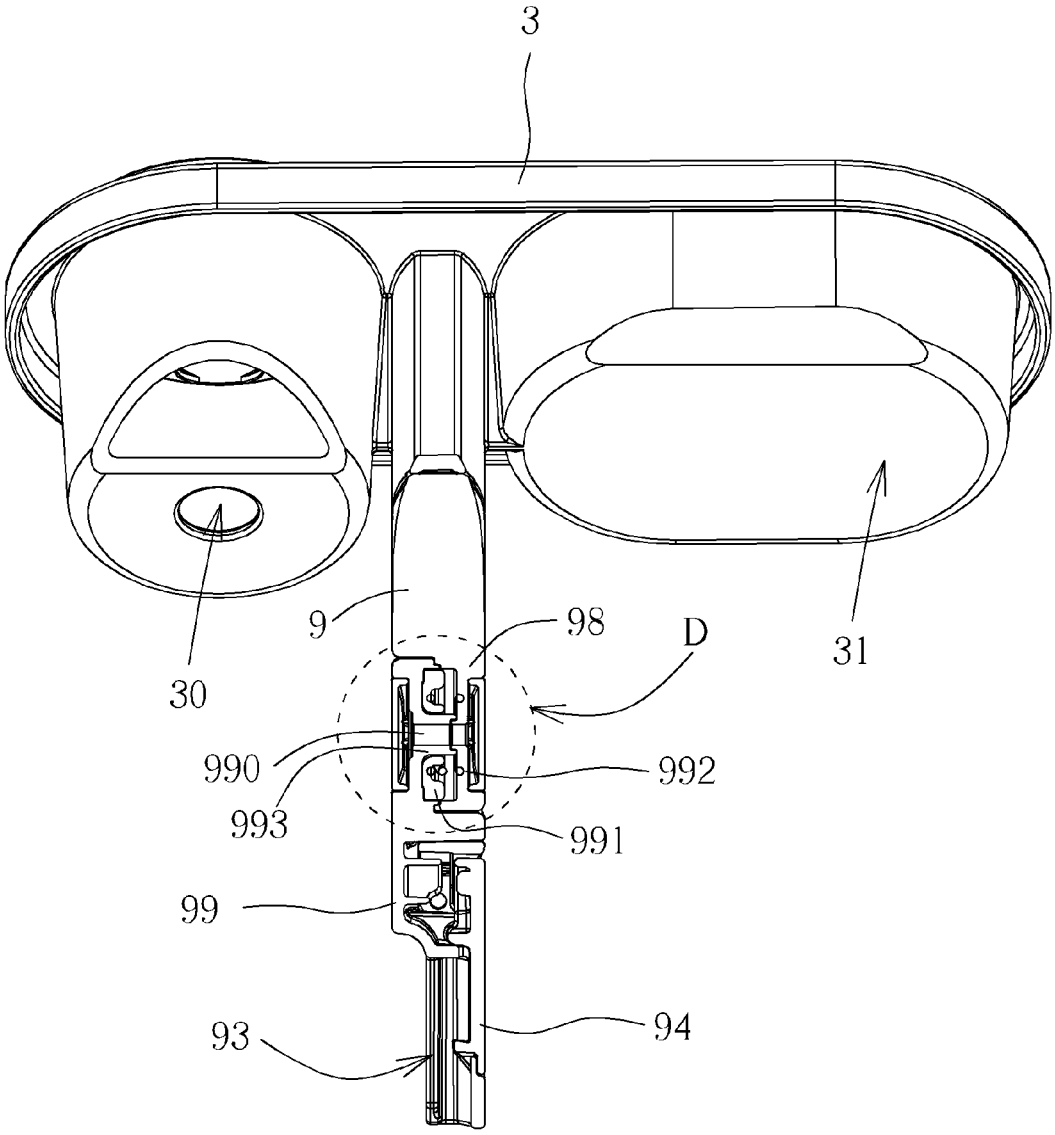
FIG. 16 is a partial cross-sectional diagram of the rotatable tray according to another embodiment of the present invention.
Figure 17:
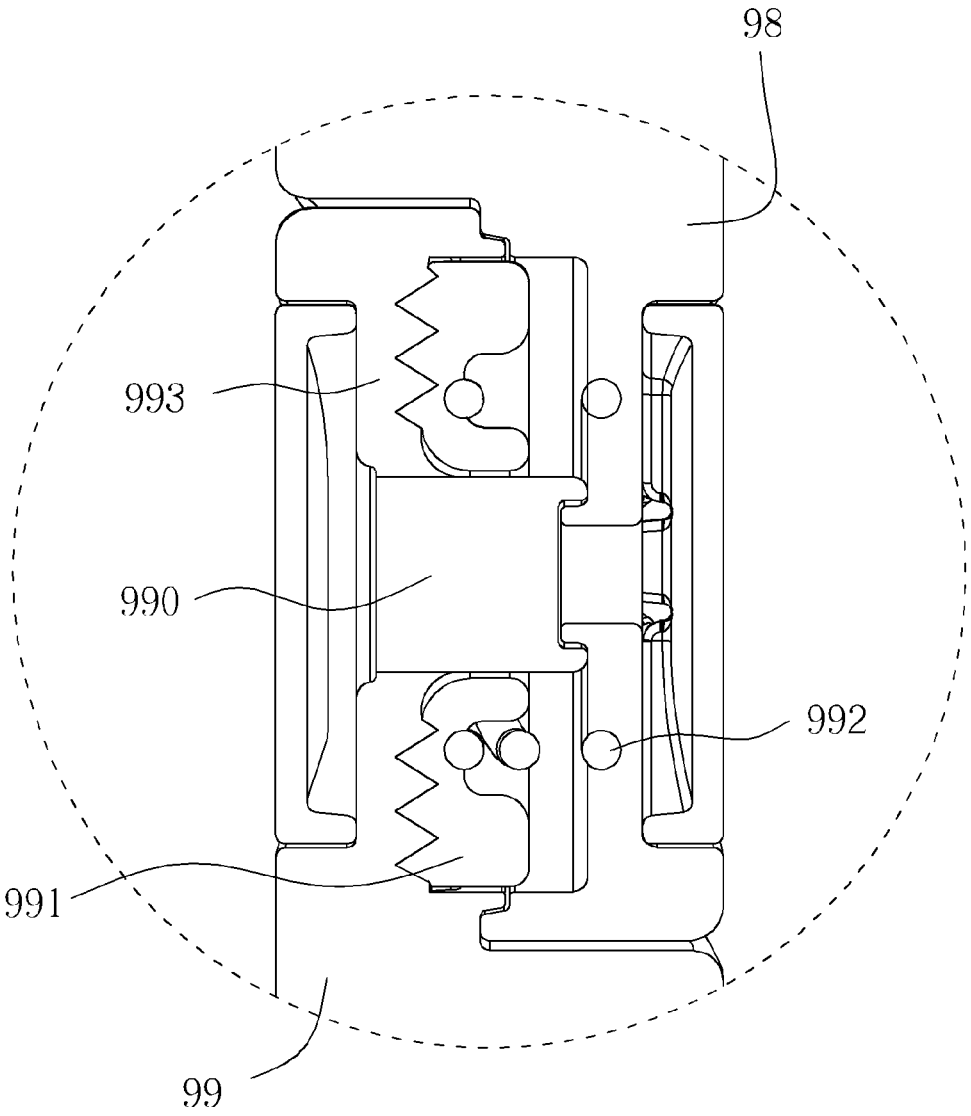
FIG. 17 is an enlarged diagram of area D in FIG. 16 according to another embodiment of the present invention.

Please refer to FIG. 14 to FIG. 17. FIG. 14 is a diagram of the rotatable tray 1 according to another embodiment of the present invention. FIG. 15 is an exploded diagram of the rotatable tray 1 according to another embodiment of the present invention. FIG. 16 is a partial cross-sectional diagram of the rotatable tray 1 according to another embodiment of the present invention. FIG. 17 is an enlarged diagram of area D in FIG. 16 according to another embodiment of the present invention. The difference between this embodiment and the aforesaid embodiment is that the rotatable tray 1 of this embodiment includes the container 4 accommodated in the first containing space 30, and the supporting base 9 is rotatable. Components with same structure of the rotatable tray 1 of this embodiment as ones of the rotatable tray 1 of the aforesaid embodiment are not reiterated herein.

In this embodiment, the supporting base 9 further includes a first connecting component 98 and a second connecting component 99, a pivoting shaft 990 is formed on an end of the second connecting component 99, and an end of the first connecting component 98 is pivoted on the second connecting component 99 via the pivoting shaft 990. An axis of the pivoting shaft 990 extends along a horizontal direction, so that the first connecting component 98 is pivoted on the second connecting component 99 in a front and rear direction of the child seat 2. The engaging base 90 is disposed on the other end of the first connecting component 98, and the connecting slot 93 and the engaging component 94 are disposed on the other end of the second connecting component 99 for connecting to the child seat 2. A positioning mechanism is disposed between the first connecting component 98 and the second connecting component 99, and the positioning mechanism is for fixing the first connecting component 98 on the second connecting component 99. The positioning mechanism includes a gear 991, a second spring 992 and a third engaging portion 993. The gear 991 slidably sheathes on the pivoting shaft 990, and the second spring 992 is disposed between the gear 991 and the first connecting component 98. The third engaging portion 993 is disposed on the second connecting component 99 and surrounds the pivoting shaft 990. The third engaging portion 993 includes a plurality of third engaging teeth, and the second spring 992 drives the gear 991 to selectively engage with the third engaging portion 993 as the first connecting component 98 rotates. The present invention is not limited to this embodiment, for example, the third engaging portion 993 can be disposed on the first connecting component 98, and the second spring 992 can be disposed between the gear 991 and the second connecting component 99.

Operation of tilting the platform 3 relative to the child seat 2 is introduced as follows. As rotating the first connecting component 98, the gear 991 compresses the second spring 992 to separate from the third engaging teeth of the third engaging portion 993, and the first connecting component 98 drives the gear 991 to slide on the pivoting shaft 990. As the first connecting component 98 rotates to a predetermined position, the second spring 992 abuts against the gear 991 so as to reengage the gear 991 with the third engaging portion 993, so that the first connecting component 98 is fixed on the second connecting component 99. Thus, a tilt angle of the platform 3 relative to the child seat 2 can be adjusted, and the rotatable tray 1 of this embodiment is more convenient for the child to sit in and get out. Therefore, an angle of the rotatable tray 1 can be adjusted so that the child can easily sit in and get out, and the tilt angle of the platform 3 can be adjusted to keep the platform 3 horizontal to the ground as the child seat 2 tilts, so as to prevent food or water placed on the platform 3 from dropping or splashing due to the tilted child seat 2.

Comparing to the prior art, the rotatable tray of the present invention includes the communicating chamber disposed on a side of the platform. The fixing base is fixed in the communicating chamber, the engaging base protrudes from the end of the supporting base so as to pivot on the fixing base, so that the platform can rotate relative to the supporting base. The positioning base is slidably up and down disposed and circumferentially fixed in the communicating chamber so that the positioning base can rotate with the platform simultaneously. The resilient component is disposed between the fixing base and the positioning base, the first engaging portion is disposed on the positioning base, and the second engaging portion is disposed on the supporting base correspondingly. As the platform rotates, the positioning base compresses the resilient component to slide upward in the communicating chamber so as to separate the first engaging portion from the second engaging portion, so that the angle of the platform relative to the child seat can be adjusted. After finishing adjusting the angle of the platform, the resilient component drives the positioning base to slide downward to engage the first engaging portion with the second engaging portion, so that the positioning portion can be fixed on the supporting base. Hence, the rotatable tray is not necessary to be detached from the child seat, and the angle of the rotatable tray relative to the child seat can be adjusted so that the child can easily sit in and get out of the child seat. The operation of the child seat is easy and rapid.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A rotatable tray installed on a child seat for accommodating a container, and the rotatable tray comprising:

a platform comprising a communicating chamber;

a fixing base fixed in the communicating chamber of the platform;

a positioning base comprising a first engaging portion, and the positioning base being slidably disposed in the communicating chamber of the platform;

a resilient component disposed between the fixing base and the positioning base; and a supporting base connected to the platform, an engaging base protruding from an end of the supporting base, a second engaging portion being disposed on the supporting base, the engaging base being pivoted in the communicating chamber so that the platform rotates relative to the supporting base, and the resilient component driving the first engaging portion to selectively engage with the second engaging portion.

2. The rotatable tray of claim 1, wherein the positioning base is circumferentially fixed and slidably up and down disposed in the communicating chamber, the first engaging portion is disposed on an end of the positioning base facing the second engaging portion, and the first engaging portion protrudes from the end of the positioning base.

3. The rotatable tray of claim 2, wherein the first engaging portion comprises a plurality of first engaging teeth, the second engaging portion correspondingly comprises a plurality of second engaging teeth surrounding a central axis of the engaging base, and the resilient component is for driving the plurality of first engaging teeth to engage with the plurality of second engaging teeth.

4. The rotatable tray of claim 3, wherein the first engaging portion comprises twelve first engaging teeth, the second engaging portion comprises twelve second engaging teeth, and an angle between two adjacent first engaging teeth or two adjacent second engaging teeth is 30 degrees substantially.

5. The rotatable tray of claim 2, wherein a stopping protrusion is formed on an outer sidewall of the engaging base, a sliding slot is formed on an inner sidewall of the positioning base, the sliding slot is a curve-shaped concave structure, the stopping protrusion is slidably installed in the sliding slot, and the stopping protrusion slides in the sliding slot as the positioning base rotates.

6. The rotatable tray of claim 5, wherein the sliding slot is a curve-shaped slot and an angle of the curve-shaped slot is 180 degrees substantially.

7. The rotatable tray of claim 1, wherein the fixing base comprises a hollow chamber, an opening is formed on an end of the hollow chamber, and two resilient arms protrude from inner sides of the fixing base.

8. The rotatable tray of claim 7, wherein an annular slot is formed on an end of the engaging base, the engaging base is pivoted on the fixing base, and the two resilient arms are engaged inside the annular slot.

9. The rotatable tray of claim 1, wherein the platform further comprises a pivoting portion and at least one containing space, and the communicating chamber is connected to the pivoting portion.

10. The rotatable tray of claim 9, wherein a concave portion is formed on a sidewall of the containing space, a shape of the container is corresponding to a shape of the containing space, and a protruding portion is formed on an outer sidewall of the container for engaging with the concave portion so as to fix the container in the containing space.

11. The rotatable tray of claim 1, wherein the child seat comprises a T-shaped connecting portion, a connecting slot is correspondingly disposed on the supporting base, and the T-shaped connecting portion is inserted into the connecting slot.

12. The rotatable tray of claim 11, wherein an engaging hole is disposed on the T-shaped connecting portion, the rotatable tray further comprises an engaging component and a first spring, a central portion of the engaging component is pivoted on the supporting base, an engaging hook is formed on an end of the engaging component, a quick release pressing portion is formed on the other end of the engaging component, and the first spring is disposed between an inner sidewall of the supporting base and the quick release pressing portion so as to drive the engaging hook to engage with the engaging hole.

13. The rotatable tray of claim 1, wherein the supporting base further comprises a first connecting component and a second connecting component, a pivoting shaft is formed on an end of the second connecting component, and the first connecting component is pivoted on the second connecting component through the pivoting shaft.

14. The rotatable tray of claim 13, wherein the first connecting component is pivoted on the second connecting component in a front and rear direction of the child seat.

15. The rotatable tray of claim 14, further comprising a positioning mechanism disposed between the first connecting component and the second connecting component, and the positioning mechanism being for fixing the first connecting component on the second connecting component.

16. The rotatable tray of claim 15, wherein the positioning mechanism comprises:

a gear slidably sheathing on the pivoting shaft;

a second spring disposed between the gear and the first connecting component; and a third engaging portion disposed on the second connecting component and surrounding the pivoting shaft, the third engaging portion comprising a plurality of third engaging teeth, and the second spring driving the gear to selectively engage with the third engaging portion as the first connecting component rotates.

* * * * *